US009746161B2

(12) United States Patent
Gielen et al.

(10) Patent No.: US 9,746,161 B2
(45) Date of Patent: Aug. 29, 2017

(54) METHOD FOR MANUFACTURING A LINEAR LIGHTING DEVICE

(71) Applicant: PHILIPS LIGHTING HOLDING B.V., Eindhoven (NL)

(72) Inventors: Vincent Stefan David Gielen, Eindhoven (NL); Reinier Imre Anton Den Boer, Eindhoven (NL); Michel Cornelis Josephus Marie Vissenberg, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/306,947

(22) PCT Filed: Apr. 30, 2015

(86) PCT No.: PCT/EP2015/059578
§ 371 (c)(1),
(2) Date: Oct. 26, 2016

(87) PCT Pub. No.: WO2015/169697
PCT Pub. Date: Nov. 12, 2015

(65) Prior Publication Data

US 2017/0051895 A1 Feb. 23, 2017

(30) Foreign Application Priority Data

May 9, 2014 (EP) ..... 14167616

(51) Int. Cl.
*F21V 17/10* (2006.01)
*F21V 15/01* (2006.01)
(Continued)

(52) U.S. Cl.
CPC ..... *F21V 17/101* (2013.01); *B21D 39/02* (2013.01); *B21D 53/00* (2013.01); *F21S 4/28* (2016.01);
(Continued)

(58) Field of Classification Search
CPC ..... F21V 15/01; F21V 15/02; F21V 15/013; F21V 15/012; F21V 17/101; F21V 29/70; B21D 39/02; B21D 5/083; B21D 5/086
(Continued)

(56) References Cited

U.S. PATENT DOCUMENTS 5,954,421 A 9/1999 McGrath
2002/0124616 A1 9/2002 Hallenstvet et al.
(Continued)

FOREIGN PATENT DOCUMENTS

CA 2731820 A1 8/2012
CN 203585972 U 5/2014
DE 2516136 A1 10/1976

OTHER PUBLICATIONS

Beguiling Smile Journal; Interesting Neighborhood Buzz . . . Importance of Roll Form in Lighting Industry, Oct. 18, 2012, pp. 1-2.

*Primary Examiner* — Jermie Cozart

(57) ABSTRACT

A method for manufacturing a linear lighting device, the method comprising the steps of providing a sheet of optically transmissive material, a sheet of thermally conductive material, and a plurality of light sources, arranging the light sources on the sheet of thermally conductive material, roll forming the sheet of thermally conductive material into a supporting heat spreader profile, roll forming the sheet of optically transmissive material into a first shape to cover the light sources and define an optical chamber, attaching end portions of the sheet of optically. The method enables the use
(Continued)

of a lower amount of material and provides an efficient method for mass manufacturing linear lighting devices.

12 Claims, 8 Drawing Sheets

(51) Int. Cl.

| | |
|---|---|
| ***F21V 3/00*** | (2015.01) |
| ***F21V 3/02*** | (2006.01) |
| ***F21V 29/70*** | (2015.01) |
| ***F21S 4/28*** | (2016.01) |
| ***B21D 39/02*** | (2006.01) |
| ***B21D 53/00*** | (2006.01) |
| *B21D 5/08* | (2006.01) |
| *F21Y 103/10* | (2016.01) |
| *F21Y 115/10* | (2016.01) |
| *F21Y 115/00* | (2016.01) |

(52) U.S. Cl.
CPC ..... *F21V 3/00* (2013.01); *F21V 3/02* (2013.01); *F21V 29/70* (2015.01); *B21D 5/08* (2013.01); *B21D 5/083* (2013.01); *F21V 15/01* (2013.01); *F21Y 2103/10* (2016.08); *F21Y 2115/00* (2016.08); *F21Y 2115/10* (2016.08)

(58) Field of Classification Search
USPC ..... 362/368, 367, 363, 362, 800
See application file for complete search history.

(56) References Cited

U.S. PATENT DOCUMENTS

| | | | |
|---|---|---|---|
| 2010/0008085 | A1 | 1/2010 | Ivey et al. |
| 2011/0235321 | A1 | 9/2011 | Ivey et al. |
| 2012/0155095 | A1 | 6/2012 | Ryan, Jr. |

METHOD FOR MANUFACTURING A LINEAR LIGHTING DEVICE

CROSS-REFERENCE TO PRIOR APPLICATIONS

This application is the U.S. National Phase application under 35 U.S.C. §371 of International Application No. PCT/EP2015/059578, filed on Apr. 30, 2015, which claims the benefit of European Patent Application No. 14167616.3, filed on May 9, 2014. These applications are hereby incorporated by reference herein.

FIELD OF THE INVENTION

The invention relates to a linear lighting device and a method of manufacturing such a linear lighting device.

BACKGROUND OF THE INVENTION

Providing new and more energy efficient illumination devices is one of the important technical challenges which society and industry faces. Basing lighting devices on Light Emitting Diodes (LEDs) which provide more light per unit of energy is a common solution. Hence, the reduced driving cost and improved performance of LEDs enable their use for general illumination. However, to reach widespread mass market proliferation of new lighting devices it is also desirable to reduce the manufacturing costs. Especially for lighting devices designed as retrofits for current lighting devices, such as incandescent bulbs and tube lighting. Retrofitable lighting devices using LEDs are currently available to the public, however the prices of such devices are often times much larger than they are for traditional lighting devices, hence the general public might still be more inclined to buy a traditional lighting device.

Thus there is a need to reduce the costs for lighting devices using LEDs to make them more available. One way to reduce the costs is to reduce the Bill Of Material (BOM), another way is to reduce the number of steps or tools required during manufacturing. US patent application 2011/0235321 for example, discloses a lighting device having a roll formed heat sink for an LED fixture, and the roll formed heat sink is then slidably inserted into an extruded light transmitting cover which will enclose the LEDs. However, the step of inserting the heat sink and LEDs into a light transmitting cover will require an additional step and further need a spacious assembly area. Further, each component need to be manipulated separately, e.g. placed or positioned, which will take time and consideration during manufacture.

SUMMARY

With regards to the above-mentioned desired properties of a lighting device, it is a general object of the present invention to provide a linear lighting device which is simple, cheap, easy to manufacture and/or mass manufacturable.

According to a first aspect of the invention, these and other objectives are achieved with a method for manufacturing a linear lighting device, the method comprising the steps of providing a sheet of optically transmissive material, a sheet of thermally conductive material, and a plurality of light sources, arranging the light sources on the sheet of thermally conductive material, roll forming the sheet of thermally conductive material into a supporting heat spreader profile, roll forming the sheet of optically transmissive material into a first shape to cover the light sources and define an optical chamber, attaching end portions of the sheet of optically transmissive material to the supporting heat spreader profile.

Linear lighting device should herein and henceforth be construed as a lighting device which is elongated in a longitudinal direction. Moreover, the purpose of the linear lighting device is to provide lighting, and the light sources, which may be light emitting diodes (LEDs) or other solid state light source, are the main components providing this function. Light emitting diodes should be understood as LED dies, LED subassemblies or packaged LEDs.

Roll forming is a well known manufacturing technique where rolls or sheets of material are formed by rollers forcing the material to be bent in creases when pulling or pushing the material along a longitudinal direction. Roll forming thus means that the rollers are configured such that the material is formed into a desired shape.

By sheet of optically transmissive material it should be understood that the material is optically transmissive for the light which, in use, is emitted from the light sources comprised in the linear lighting device. End portions of the sheet of optically transmissive material should herein be construed as the outer edges of the sheet which are parallel to the longitudinal direction. The optical chamber will determine the optical characteristics of the device, such as the shape of the optical chamber determining in what direction light is emitted. The sheet of thermally conductive material should be understood to be able to conduct heat from the light source which are arranged on the sheet in order for them to function properly without overheating. Moreover, a high temperature will reduce the lifetime of a solid state light source. By conducting heat away from the light source, the lifetime of the light sources will be prolonged.

By roll forming the sheet of thermally conductive material into a supporting heat spreader profile, it should be understood that the sheet has been formed into a shape having a supporting function with a torsional stiffness. Furthermore, attaching end portions of the sheet of optically transmissive material to the supporting heat spreader profile enables both the supporting heat spreader profile and the sheet of optically transmissive material to provide stiffness to the linear lighting device. Moreover, the roll formed sheet of optically transmissive material provides the desired optical characteristics in accordance with the shape chosen for the optical chamber.

To lower the BOM for producing a linear lighting device the sheet of optical transmissive material and the sheet of thermally conductive material are provided in dimensions, i.e. sizes, corresponding to the size of material needed for the shape of the supporting heat spreader profile and the first shape for the optical chamber, thus minimizing the material wasted during manufacturing.

The present invention is based on the realization that by providing a semi-finished components such as a sheet of optically transmissive material and a sheet of thermally conductive material, these may be roll formed in order to produce a high quantity of linear lighting devices in a linear production process. Thereby, the present invention allows for manufacturing of linear lighting devices suitable as retrofits for current linear lighting devices. Further, the present invention allows for a low cost production with a minimal amount of wasted material.

In one embodiment, the step of attaching may comprise clamping the end portions in clamping portions formed as longitudinal slots roll formed in the supporting heat spreader profile. By longitudinal slots it should be understood that the slots are formed in the direction of production, i.e. along the linear directions of the linear lighting device. The longitudinal slots will allow the sheet of optically transmissive material to be clamped to the supporting heat spreader by the end portions, thereby securely fixating it in a preferred shape which defines an optical chamber. By clamping it should be understood that the sheet of optically transmissive material has clamping, i.e. normal forces incident from each side such that movement out of the clamping portion is impeded by the friction, i.e. direct contact induced by the heat spreader profile.

In another embodiment, the step of attaching may form the sheet of optically transmissive material into a second shape. The second shape may also be construed as a final shape of the linear lighting device. The second shape may be more complex and hence would require a more advanced roll forming process. It is thereby possible to allow for an easy step of roll forming the sheet of optically transmissive material into a simple first shape prior to the step of attaching, which may form the sheet of optically transmissive material into the second shape. Further, the second shape of the optical chamber may provide similar optical characteristics as the first shape if desired, or other advantageous optical characteristics.

In one embodiment, the step of attaching may comprise crimping portions of the supporting heat spreader profile to fixate the end portions. By crimping it should be understood that the supporting heat spreader profile is crimped around end portion of the transmissive material. The crimped portions of the supporting heat spreader profile will securely hold the end portions of the sheet of optically transmissive material in place.

In another embodiment, the crimping of the portions of the supporting heat spreader profile is performed by roll forming. Roll forming to crimp the portions of the supporting heat spreader profile may advantageously be used to alleviate the need of extra tools or steps of the manufacturing process.

In one embodiment the method may further comprise roll forming, after the step of attaching, the supporting heat spreader profile, such that the sheet of optically transmissive material is formed into another shape which covers the light sources and defines an optical chamber. The shape assumed after roll forming may also be construed as a final shape of the linear lighting device. Thereby it is possible to allow for a simple first shape of the sheet of optically transmissive material. Hence, a simple first shape may be used for the step of attaching, while a more complex second shape is then provided. A more complex second shape may provide e.g. directionality of the light emitted by the linear lighting device or similar optical effects.

In another embodiment, roll forming the supporting heat spreader profile may comprise forming at least four longitudinal slots, the longitudinal slots being arranged in pairs either forming two slots having substantially parallel planes in a longitudinal extension or two slots forming the bottom half of an 'X', thereby the supporting heat spreader profile allows at least two different first shapes of the roll formed sheet of optically transmissive material to be attached to the profile. By substantially parallel planes in a longitudinal extension it is understood that the slots forming such a pair are in essence parallel along the direction of the linear lighting device and from a transverse cross-section appear as two parallel lines. Hence, the two paired slots forming the bottom half of an 'X' will appear as the bottom half of an 'X' in a transverse cross-section of the supporting heat spreader profile. By forming at least four longitudinal slots, the sheet of optically transmissive material may be roll formed and attached to one supporting heat spreader profile in two possible first shapes. Thereby, two linear lighting devices having different optical characteristics may be manufactured from a supporting heat spreader profile. This advantageously reduces the time needed to reconfigure the production process to produce a linear lighting device having other optical characteristics.

In one embodiment, the method may further comprise: providing at least a second sheet of optically transmissive material, roll forming the second sheet of optically transmissive material into a first shape to cover the first sheet of optically transmissive material thereby forming a second optical chamber, and attaching the second sheet to the supporting heat spreader profile. The first sheet of optically transmissive material may be roll formed and attached to the supporting heat spreader profile and then a second sheet of optically transmissive material which will cover the first sheet may be roll formed and attached to the supporting heat spreader profile. The second sheet will cover the first sheet and form a second optical chamber. By providing a second sheet, the first and second sheet may have different optical characteristics which in combination form the desired light to be emitted in an e.g. desired direction or desired characteristics such as wavelength conversion and/or diffusion. A single sheet having all these characteristics may be very expensive or hard to produce, while a combination of two sheets may provide the desired optical characteristics in a simple and efficient manner.

In another embodiment, the method may further comprise the step of providing mounting levers connected to the linear lighting device, the mounting levers being configured to allow a user to elastically deform the supporting heat spreader profile for mounting the linear lighting device to a linear lighting device holder. The mounting levers may be an integrated part of the linear lighting device, or separate parts. Elastically deforming the linear lighting device to mount the linear lighting device may allow a user an easier step of replacing older devices. Further, the mounting levers may reduce smudges from contact with e.g. bare skin of fingertips while handling the device.

In one embodiment the supporting heat spreader profile may comprise a plurality of parallel linear longitudinal portions, each linear longitudinal portion being configured for attaching a sheet of optically transmissive material. The method may further comprise: arranging the light sources on each linear longitudinal portion, providing a plurality of sheets of optically transmissive material, roll forming the plurality of sheets of optically transmissive material into a plurality of parallel optical chambers covering and defining an optical chamber for each linear longitudinal portion, and attaching the plurality of sheets of optically transmissive material to the supporting heat spreader profile. To provide a larger amount of lighting, for example to cover a larger area, it is beneficial to provide a plurality of parallel linear longitudinal portions which, in use, will provide lighting from the linear lighting device. As several sheets of optically transmissive material are used, it is possible to provide different optical characteristics for each parallel linear longitudinal portion. Hence, the linear lighting device will be provided with an increased lighting ability and interesting aesthetics. Furthermore, each parallel linear longitudinal portion may have a slightly different directionality of the light emitted to provide a more diffuse general lighting from the linear lighting device.

In one embodiment, the method may further comprise the step of separating each linear longitudinal portion of the heat spreader profile into an individual linear lighting device.

Separating each linear longitudinal portion will even further enable mass manufacturing parallel linear lighting devices in a production process also using roll forming. Thus, a large number of linear lighting devices can be constructed in a smaller amount of time.

In another embodiment the supporting heat spreader profile may comprise a plurality of parallel linear longitudinal portions, each linear longitudinal portion being configured for attaching a sheet of optically transmissive material. The method may further comprise: arranging the light sources on each linear longitudinal portion, roll forming the sheet of optically transmissive material into a plurality of parallel optical chambers covering and defining an optical chamber for each linear longitudinal portion, and attaching the sheet of optically transmissive material to the supporting heat spreader profile. By only using one sheet of optically transmissive material an easier handling and manufacturing is provided while manufacturing each parallel linear longitudinal portion.

According to a second aspect of the present invention, the objectives are also achieved by a linear lighting device manufactured according to the first aspect. Accordingly, the objectives are also achieved by a linear lighting device linear lighting device comprising a roll-formed supporting heat spreader profile formed from a sheet of thermally conductive material, a plurality of light sources arranged on the supporting heat spreader profile, and a roll-formed sheet of optically transmissive material having end portions connected to the supporting heat spreader profile, the roll-formed sheet of optically transmissive covering said light sources and defining an optical chamber. Effects and features of this second aspect of the present invention are largely analogous to those described above in connection with the first aspect of the invention.

Further features of, and advantages with, the present invention will become apparent when studying the appended claims and the following description. The skilled person realizes that different features of the present invention may be combined to create embodiments other than those described in the following, without departing from the scope of the present invention. For example the light source may be a different light generator such as e.g. laser diodes, lasers, flash lamps, Xenon lamps or even X-ray sources. Further, the skilled person realizes that applying the steps of the claimed method may be applied in a different order without departing from the scope of the present invention.

BRIEF DESCRIPTION OF THE DRAWINGS

These and other aspects of the present invention will now be described in more detail, with reference to the appended drawings showing different embodiments of the invention.

DETAILED DESCRIPTION OF THE DRAWINGS

In the present detailed description, embodiments of a method for manufacturing a linear lighting device according to the present invention are mainly discussed with reference to a cross-section showing the final shape of the linear lighting device. It should be noted that this by no means limit the scope of the invention, which is also applicable in other circumstances for instance with other linear lighting devices having transverse cross-sections achievable using roll forming. Further, the present invention is mainly discussed using solid state light sources such as LEDs, however the present invention is also applicable using other types of light sources. Moreover the amount of LEDs shown in the enclosed drawings is only a schematic representation. In use, the number, concentration and other such details will be decided by each application. LEDs should be broadly interpreted as LED dies, LED subassemblies, packaged LEDs or the like.

The invention will now be described with reference to the enclosed drawings where first attention will be drawn to the structure, and secondly functions of the linear lighting device will be described.

Figure 1A:
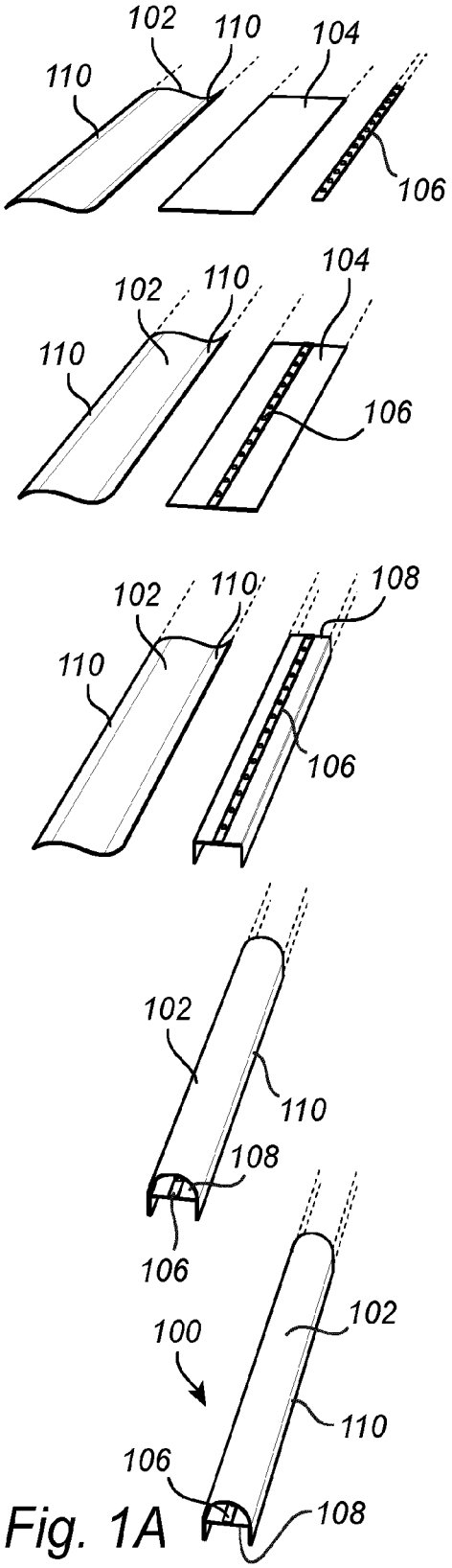
FIG. 1A and is a perspective view of a linear lighting device during manufacturing, where the steps of a method for manufacturing a linear lighting device are shown in FIG. 1B.
Figure 1B:
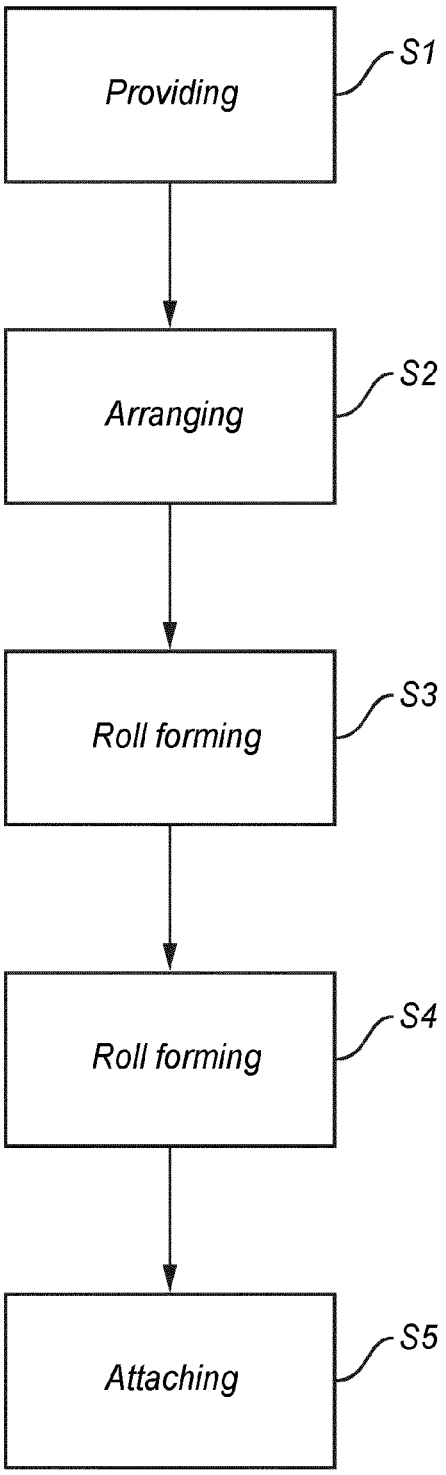

FIG. 1A contains perspective views of a method for manufacturing a linear lighting device 100, and FIG. 1B is a flowchart corresponding to the steps of the method illustrated in FIG. 1A. Note that the steps in the flowchart is arranged side-by-side with the step of the method corresponding to the illustrated step.

First in step S1, a sheet of optically transmissive material 102 is provided together with a sheet of thermally conductive material 104, and a plurality of light sources 106. Note that the plurality of light sources therein is shown as a row of LEDs, henceforth called light sources 106. Further also note that no details are provided of the rollers of the roll forming process, as this is a well known subject. Each such configuration would be decided by the application at hand. Each sheet 102, 104 and light source 106 have dotted lines indicating that each of them may for instance be provided in a substantially endless manner, e.g. from a large roll having the sheet in a desired width thereupon rolled. The desired width would be decided by the linear lighting device 100 to be manufactured and the desire to minimize the wasted material during manufacture.

Secondly, in step S2 the light sources 106 are arranged on the sheet of thermally conductive material 104. It should be understood that there is now a thermal contact between the light sources 106 and the sheet 104 such that the sheet 104 may conduct heat away from the light sources 106 for the light sources 106 to function properly and prolong their lifetime, as the lifetime of high efficiency LEDs is shortened by too high temperatures.

In the next step S3, the sheet of thermally conducting material 104 is roll formed into a supporting heat spreader profile 108 on which the light source 106 are still attached and in thermal contact. The roll formed supporting heat spreader profile 108 will provide a portion of the torsion stiffness for the linear lighting device 100. Also note that the shape of the heat spreader profile shown in FIG. 1A is not the only shape to which a sheet of thermally conductive material 104 may be roll formed, more examples according to embodiments of the invention are shown in the enclosed drawings.

Then, in step S4, the sheet of optically transmissive material 102 is roll formed into a first shape to cover the light sources 106 and define an optical chamber. The shape of the optical chamber will determine the distribution of light from the linear lighting device 100. Moreover the sheet of optically transmissive material 102 may comprise structures and or materials providing optical effects which are discussed below.

In the next step S5 end portions 110 of the roll formed sheet of optically transmissive material 104 is attached to the supporting heat spreader profile 108 thus forming a linear lighting device 100.

In use, electricity is provided to the light sources 106 through electrical connections (not shown), and the light sources 106 will emit light towards the inside of the sheet of optical transmissive material through the optical chamber. The light will refract in the interface with the sheet of optical transmissive material 102, and be guided through the sheet of optical transmissive material 102 to the outside of the linear lighting device 100 and provide lighting to an area.

The sheet of optically transmissive material 102 may comprise diffusing elements configured to scatter light propagating through the sheet 102, or a collimated micro lens foil, or a prismatic foil, or a wavelength converting material, or surface structures configured to tune the light distribution and combinations thereof. The diffusing elements and/or wavelength converting material may be comprised in: a pattern printed on the sheet of optically transmissive material 102, or on a film laminated on the sheet of optically transmissive material 102 and/or a material co-extruded with the sheet of optically transmissive material 102 and combinations thereof. A wavelength converting material may convert the light into a desired second wavelength or wavelength spectrum and thus provide a desired aesthetic look and feel. Common wavelength converting materials often comprise phosphor which converts blue light emitted by high efficiency LEDs to yellow light, which in combination provide white light with a desirable natural look and feel. The sheet of optically transmissive material 102 may be formed in a suitable plastic material that allows it to be roll formed to the linear lighting device 100 to which it is to be used. Examples of such plastic materials are PC (polycarbonate), PVDF (polyvinylidene fluoride), PMMA (polymethyl methacrylate), and PET (polyethylene terephthalate).

The sheet of thermally conductive material 104 can be formed by a metal sheet as most metal have a high thermal conductivity and provide a good stiffness. Hence, the sheet of thermally conductive material 104 may be 0.2-0.4 mm thick. Furthermore, the sheet of thermally conductive material may comprise one of a precoated reflective band material or a Miro highly reflective material or combination thereof. By further enabling the surface of the supporting heat spreader profile 108 to efficiently reflect light, a larger amount of light will be emitted from the linear lighting device 100.

The end portions 110 of the sheet of optically transmissive material 102 may be attached to the supporting heat spreader profile 108 by various methods such as pinching, clinching, friction welding or ultrasonic welding, a combination thereof is of course also possible. Further examples of attaching the sheet of optically transmissive material 102 to the supporting heat spreader profile 108 will be discussed below together with other embodiments of the present invention.

Figure 2A:
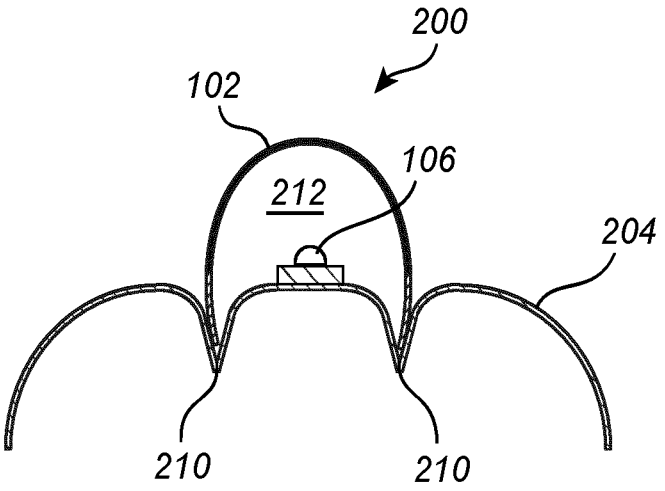
FIGS. 2A and 2B are transverse cross-sections of a linear lighting device manufactured according to another embodiment of the invention.
Figure 2B:
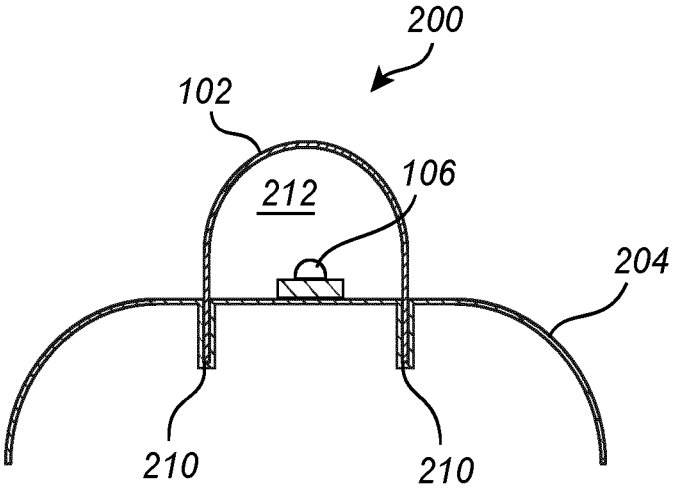

FIGS. 2A and 2B are cross-sectional views of another embodiment of the invention. In the linear lighting device 200 shown in FIGS. 2A and 2B the supporting heat spreader profile 204 comprises clamping portions 210 formed as longitudinal slots roll formed in the supporting heat spreader profile 204. Referring first to FIG. 2A, where the sheet of optically transmissive material 102 has been roll formed but is still not attached to the supporting heat spreader 204. The clamping portions 210 of the supporting heat spreader profile 204 are not closed/clamped in order to allow an easy insertion of the sheet of optically transmissive material 102, this may preferably be done by elastically and temporarily bending the heat spreader profile 204 to open the clamping portions 210. Then, in FIG. 2B, the end portions 110 of the sheet of optically transmissive material 102 has been inserted into the clamping portions 210 and the heat spreader profile 204 is released back to the normal shape. Thereby the sheet of optically transmissive material 102 is attached to the heat spreader profile by the clamping portions 210 clamping the end portions 110 of the sheet of optically transmissive material 102. Thus, the sheet of optically transmissive material 102 is attached and fixated in a first shape. Note that the step of attaching, i.e. clamping the end portions 110 of may also form the sheet of optically transmissive material into a second shape. This is illustrated by the different shape of the optical chamber 212 in FIG. 2B compared to FIG. 2A.

Figure 3A:
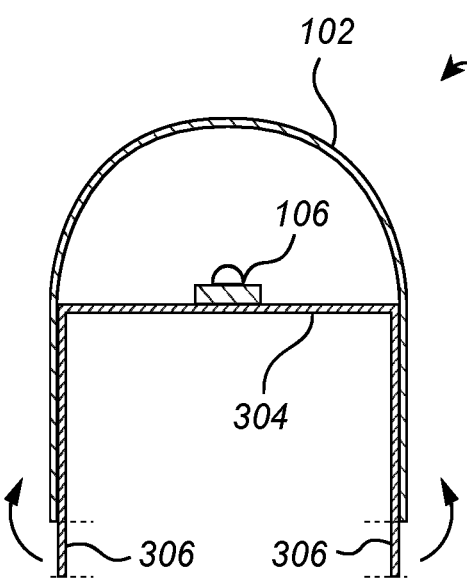
FIGS. 3A, 3B and 3C are transverse cross-sections of a linear lighting device manufactured according to another embodiment of the invention.
Figure 3B:
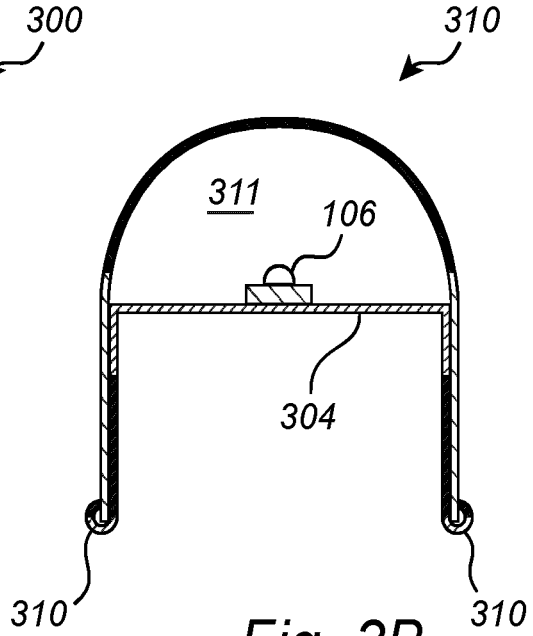
Figure 3C:
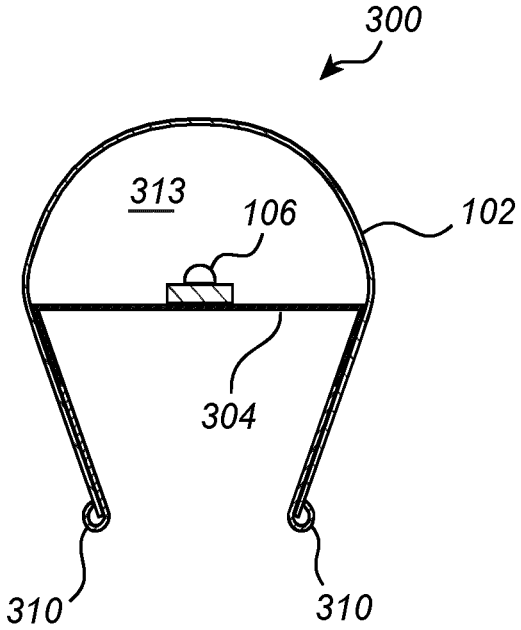

FIGS. 3A, 3B and 3C are cross-sectional views of another embodiment of the invention. In the linear lighting device 300 shown in FIGS. 3A and 3B the supporting heat spreader profile 304 has portions 306 thereof crimped in order to attach the end portions 110 of the sheet of optically transmissive material 102 to the heat spreader profile 304. First referring to FIG. 3A, the heat spreader profile 304 extends further than the sheet of optically transmissive material 102, thus providing portions to be crimped 306. The portions to be crimped 306 have their crimping directions indicated by the arrows 308. In FIG. 3B, the portions 306 are shown after the step of crimping and now form the crimped portions 310. The crimped portions 310 securely hold and thereby fixate the sheet of optically transmissive material 102, and thereby securely attach the sheet of optically transmissive material 102 in the first shape defining the optical chamber 311. The optical chamber 311 will determine e.g. the directionality of light being emitted from the linear lighting device 300.

Now referring to FIG. 3C, compared to the embodiment shown in FIG. 3B the supporting heat spreader profile 304 has been roll formed, after the step of attaching the sheet of optically transmissive material 102. Thereby, the sheet of optically transmissive material 102 forms a second shape which covers the light sources 106 and defines an optical chamber 313 which has a different shape compared to the optical chamber 311 shown in FIG. 3B. Therefore, the optical chamber 313 will also provide other optical characteristics, for example a more diffuse lighting due to the wider optical chamber 313.

Figure 4A:
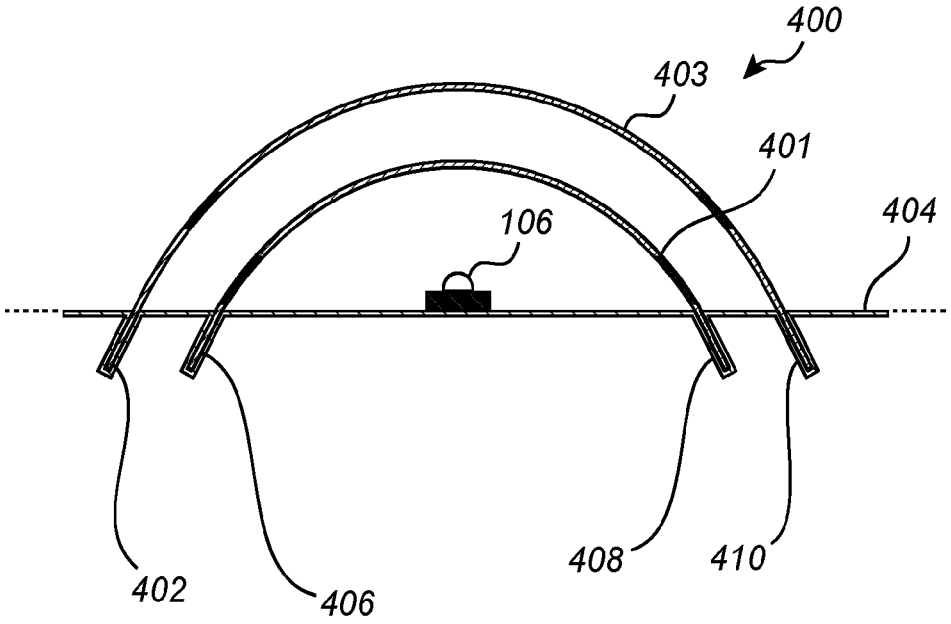
FIGS. 4A, 4B and 4C are perspective views of a linear lighting device manufactured according to another embodiment of the invention.
Figure 4B:
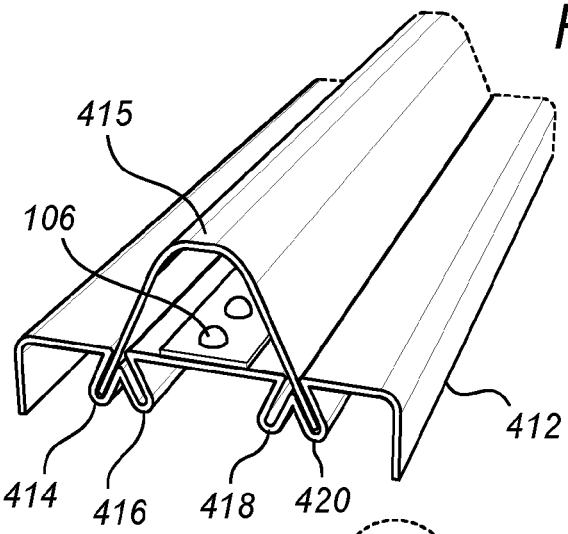
Figure 4B:
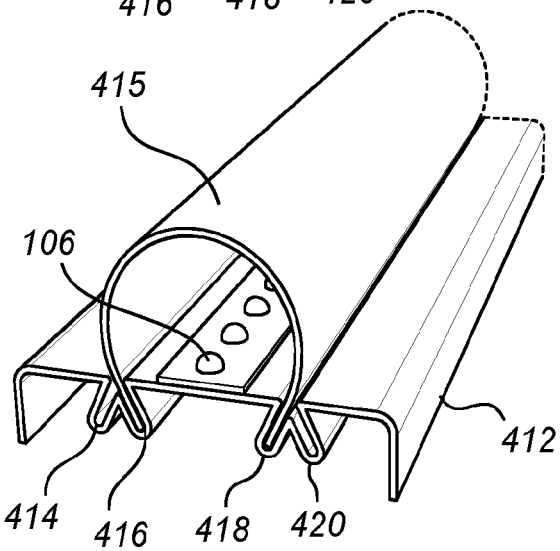
Figure 4C:
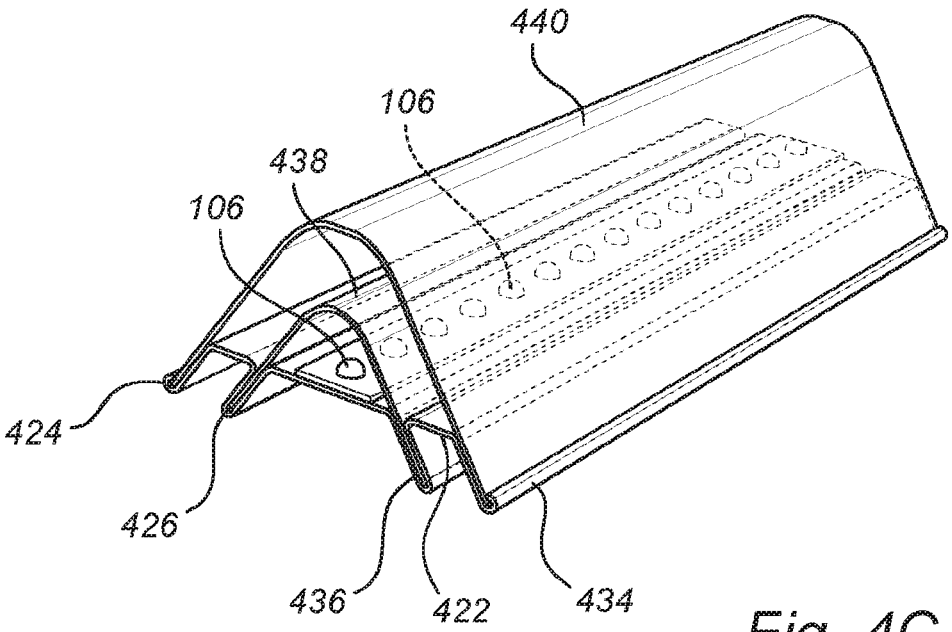

FIGS. 4A, 4B and 4C are perspective views of another embodiment of the invention. The linear lighting device shown in FIG. 4A comprises a supporting heat spreader profile 404 which has four longitudinal slots 402, 406, 408, 410 for attaching a sheet of optically transmissive material. The longitudinal slots are arranged in pairs of two slots having substantially parallel planes in a longitudinal extension of a linear lighting device. The linear lighting device further comprises light sources 106 arranged on the heat spreader profile 404, and roll formed sheets of optically transmissive material 401, 403 which are attached by their end portions by clamping to the slots 402, 406, 408, 410. Note that it is also possible and within the scope of the invention to attach only one sheet of optically transmissive material from either of inner slots 406, 408 or outer slots 402, 410 to either of the inner slots 406, 408 or outer slots 402, 410.

Similar to the embodiment shown in FIG. 4A, linear lighting device shown in FIG. 4B comprises a supporting heat spreader profile 412 which has four longitudinal slots 414, 416, 418, 420. The slots 414, 416, 418, 420 are also arranged in pairs, however their shape is the bottom half of an 'X' seen from a transverse cross-section. The pairs of slots 414, 416 respectively 418, 420 share an opening. However it is also possible that the inner slots 416, 418 or outer slots 412, 420 are spaced apart and thus have separate openings. The linear lighting device shown in FIG. 4B further comprises light sources 106 arranged on the heat spreader profile 412, and a roll formed sheet of optically transmissive material 415 which is attached by the end portions by clamping to the slots 414, 416, 418, 420. Note that attaching the roll formed sheet of optically transmissive material 415 to either the inner slots 416, 418 or outer slots 412, 420 is possible to provide different shapes for the roll formed and attached sheet of optically transmissive material which defines the optical chamber.

Now referring to FIG. 4C, where the supporting heat spreader profile 422 has a similar design as to the two embodiments shown in FIGS. 4A and 4B. The linear lighting device shown in FIG. 4C comprises a supporting heat spreader profile 422 which comprises four possible connections between the supporting heat spreader profile 422 and a sheet of optically transmissive material 438, 440. The two outer portions 424, 434 of the supporting heat spreader profile 422 which may be crimped to attach a sheet of optically transmissive material 440, and the two inner slots 426, 436 which may be used to clamp a sheet of optically transmissive material 438 in order to attach the end portions of a the sheet to the supporting heat spreader profile 422. The linear lighting device further comprises light sources 106 arranged on the heat spreader profile 422.

The supporting heat spreader profiles 404, 412, 422 provides the possibility of attaching a roll formed sheet of optically transmissive material into two different shapes using the same supporting heat spreader profile 404, 412, 422 and thus allowing for different configurations of the light emitted from the linear lighting device comprising such a supporting heat spreader profile 404, 412, 422. It should be understood that the different connections shown could be combined, and that one of the pairs of slots could be shaped as the bottom half of an 'X', and the other pair be two slots having substantially parallel planes in a longitudinal extension, or that such a pair can be combined with portions to be crimped for attaching the end portion of a sheet of optically transmissive material. The supporting heat spreader profiles 404, 412, 422 thus allow for different linear lighting devices to be manufactured using the same supporting heat spreader profile 404, 412, 422.

Further, the embodiments shown in FIGS. 4A, 4B and 4C allow a second sheet of optically transmissive material to be roll formed into a first shape and attached by its end portions to the outer pair of slots 402, 410, 414, 420 or portions to be crimped 424, 434. The second sheet will cover the first sheet and form a second optical chamber. By providing a second sheet, the first and second sheet may have different optical characteristics which in combination form the desired light to be emitted in an e.g. desired direction or desired characteristics such as wavelength conversion and/or diffusion. A single sheet having all these characteristics may be very expensive or hard to produce, while a combination of two sheets may provide the desired optical characteristics in a simple and efficient manner.

Figure 5A:
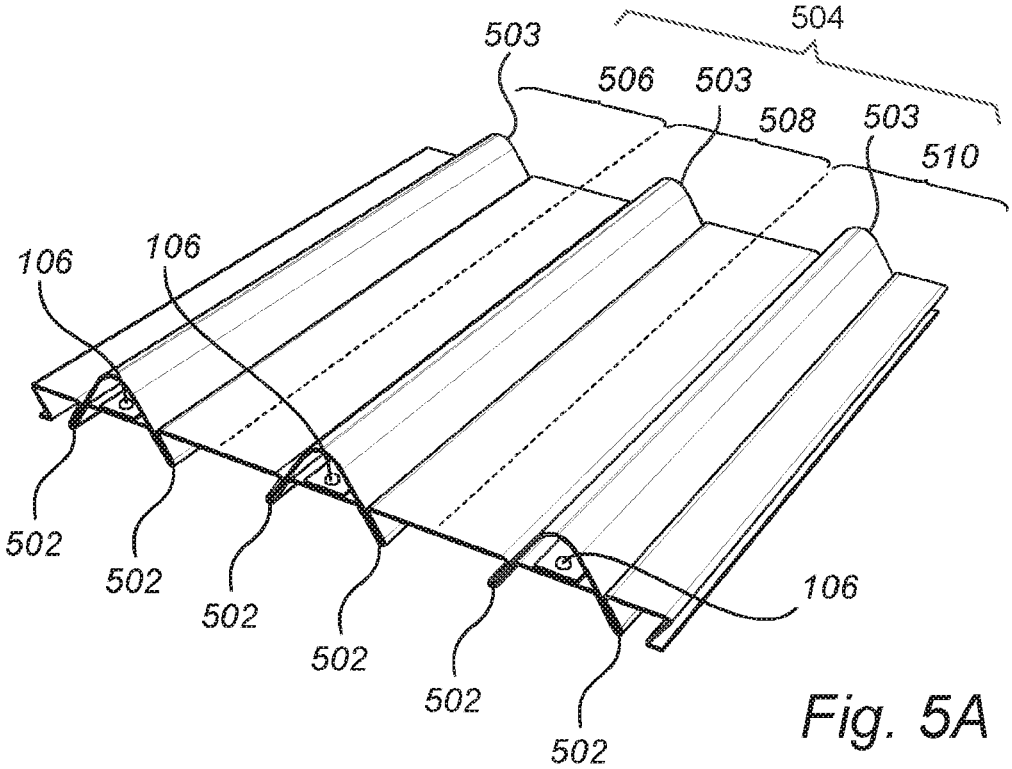
FIGS. 5A and 5B are perspective views of a linear lighting device manufactured according to another embodiment of the invention.

FIG. 5A is a perspective view of another embodiment of the invention. In the embodiment shown in FIG. 5A the linear lighting device comprises a supporting heat spreader profile 504 which comprises a plurality of parallel linear longitudinal portions 506, 508, 510, each linear longitudinal portion 506, 508, 510 being configured for attaching a sheet of optically transmissive material 503 by the slots 502. To provide more lighting for e.g. a larger area a plurality of parallel linear longitudinal portions 506, 508, 510 can be provided each of which, in use, will provide lighting from the linear lighting device. Further, as several sheets of optically transmissive material 503 are attached, it is possible to provide different optical characteristics for each parallel linear longitudinal portion 506, 508, 510. Hence, the linear lighting device can be provided with an increased lighting output and either interesting aesthetics or possibility of tuning the light differently in different directions of the linear lighting device.

Note the dotted lines, which indicate each linear longitudinal portion 506, 508, 510 of the heat spreader profile. Each linear longitudinal portion 506, 508, 510 may be separated from the other, as the distance between each sheet of optically transmissive material 503 is large enough for them to function as separate linear lighting devices. Separating each linear longitudinal portion, and thus manufacturing a linear lighting device from each portion 506, 508, 510 will even further enable mass manufacturing parallel linear lighting devices. As parallel production is combined with using roll forming, a large number of linear lighting devices can be constructed in even less time.

Figure 5B:
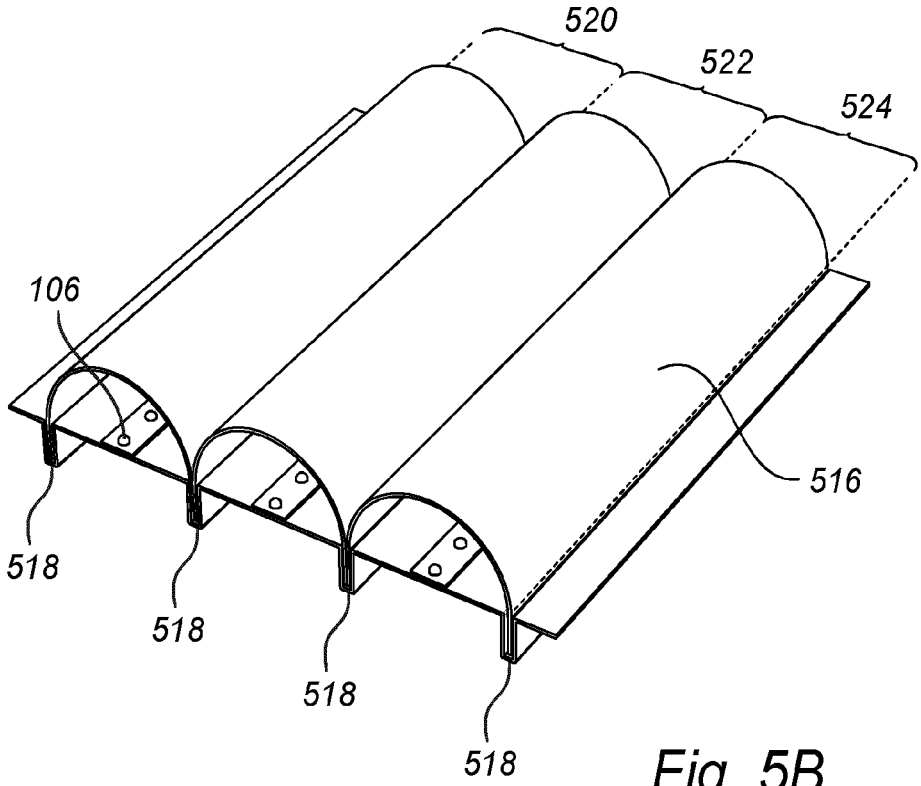

FIG. 5B is a perspective view of another embodiment of the invention. In the embodiment shown in FIG. 5B the supporting heat spreader profile 514 comprises a plurality of parallel linear longitudinal portions 520, 522, 524, each linear longitudinal portion being configured for attaching a sheet of optically transmissive material 516. The sheet of optically transmissive material 516 is attached to the supporting heat spreader profile 514 by the slots 518 clamping the sheet. Similar to the embodiment shown in FIG. 5A it is beneficial to provide a plurality of parallel linear longitudinal portions which, in use, will provide lighting from the linear lighting device. For the embodiment shown in FIG. 5B only one sheet of optically transmissive material is used, thereby providing an easy handling of the sheet while manufacturing each parallel linear longitudinal portion. The slots 518 holding the sheet of optically transmissive material 516 may be pinched after the sheet 516 has been inserted to securely fixate the sheet 516.

Figure 6A:
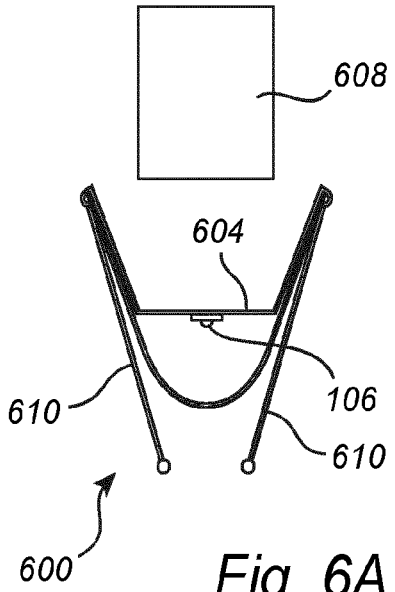
FIGS. 6A and 6B are transverse cross-sections of a linear lighting device manufactured according to another embodiment of the invention.
Figure 6B:
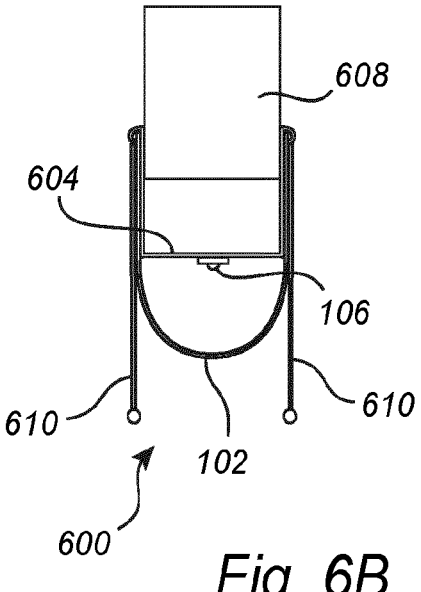

FIGS. 6A and 6B are cross-sectional views of another embodiment of the invention. Compared to the earlier mentioned embodiments, the linear lighting device 600 shown in FIG. 6A further comprises mounting levers 610. The mounting levers are connected to the linear lighting device 600 in order for a user to be able to elastically temporarily deform the supporting heat spreader profile 604 to mount the linear lighting device 600 to a linear lighting device holder 608. FIG. 6A shows the linear lighting device 600 having been elastically deformed, and FIG. 6B shows the device having been mounted to the linear lighting device holder 608. Furthermore the mounting levers 610 may be removable or foldable such that they do no block the light being emitted from the linear lighting device 600. By making the step of mounting the linear lighting device 600 easier for a user, the user may be more inclined to replace older lighting devices. Further, the mounting levers 610 may reduce smudges from contact with e.g. bare skin of fingertips while handling the linear lighting device 600.

FIGS. 7A, 7B, 7C and 7D are perspective views of other embodiments of the invention.

Figure 7A:
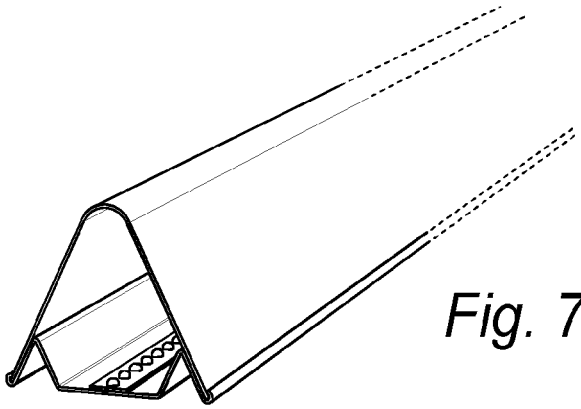
FIGS. 7A, 7B, 7C and 7D are perspective views of linear lighting devices manufactured according to another embodiment of the invention.
Figure 7B:
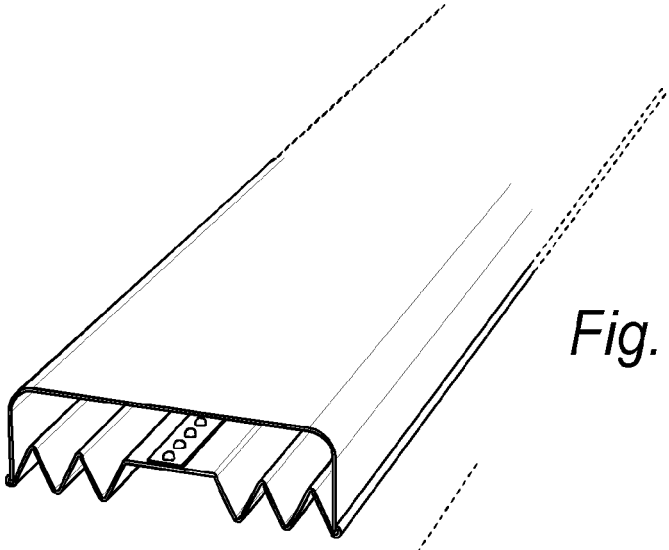
Figure 7C:
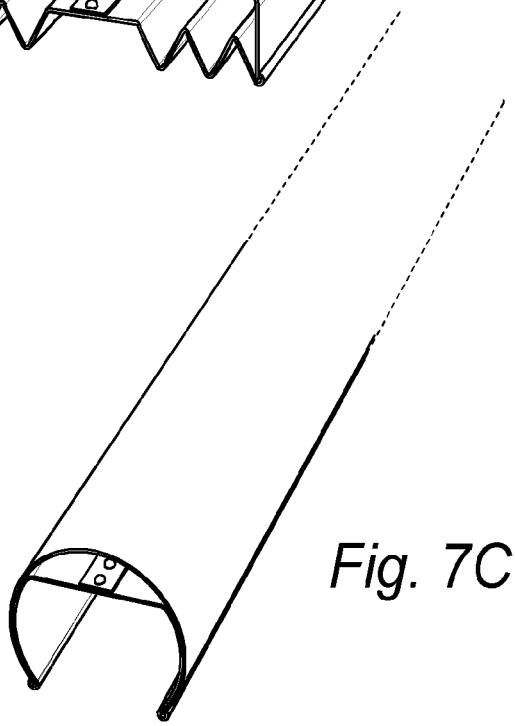
Figure 7D:
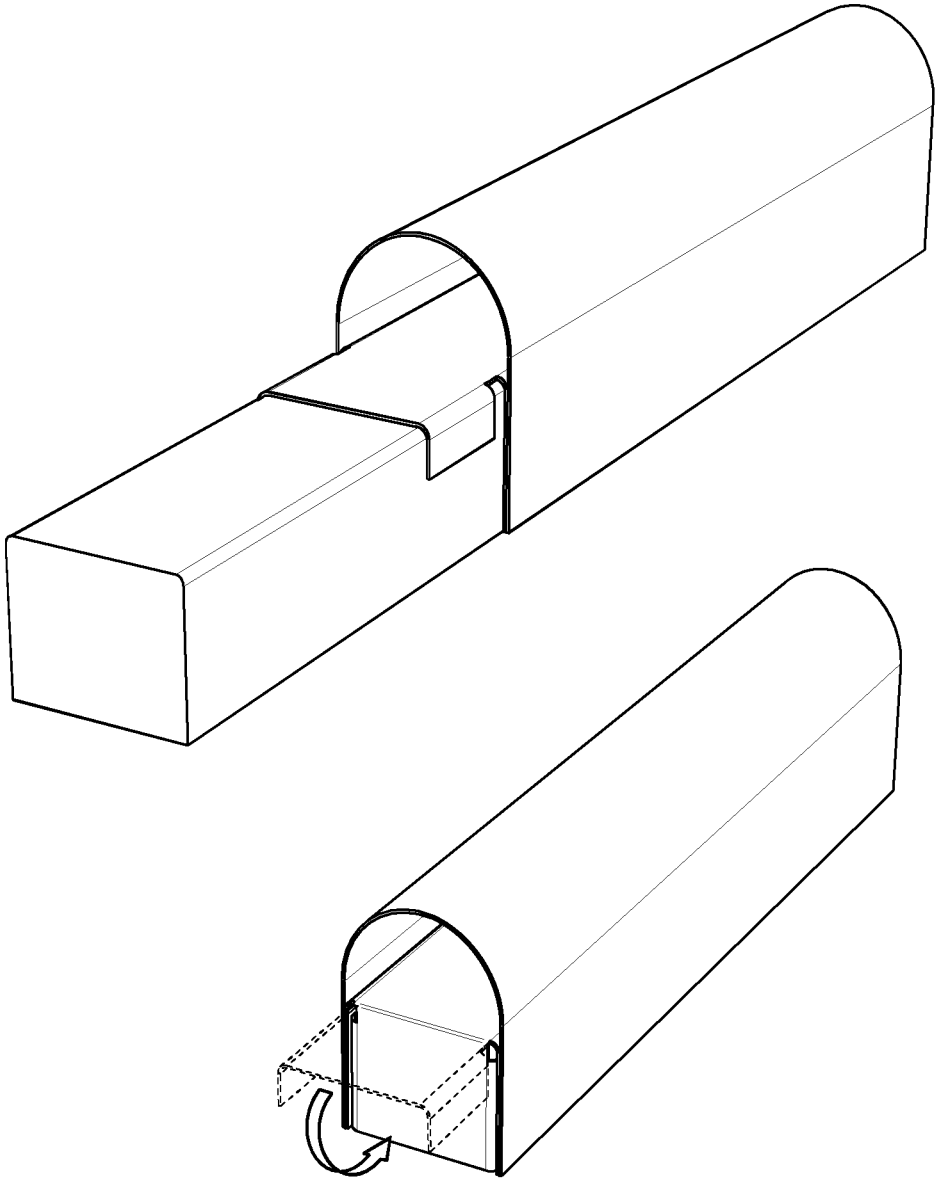

In the embodiment shown in FIG. 7A a linear lighting device having large optical chamber with a heat spreader profile with large reflective surfaces is shown. The large reflective surfaces together with the large optical chamber may provide a pleasing diffuse light. In the embodiment shown in FIG. 7B a linear lighting device having a low and stiff heat spreader profile which provides large cooling surfaces is shown. In the embodiment shown in FIG. 7C a linear lighting device having a cylindrical linear lighting device with a small optical chamber is shown. In the embodiment shown in FIG. 7D steps of a method for manufacturing a linear lighting device is shown. The method for manufacturing further comprises cutting a lid in the heat spreader profile. The method comprises folding the cut lid into place to close the heat spreader profile. These steps may be performed for forming a closed space where driver electronics for the light sources may be mounted.

Even though the invention has been described with reference to specific exemplifying embodiments thereof, many different alterations, modifications and the like will become apparent for those skilled in the art. For example the light source is preferably a solid state light emitter. Examples of solid state light emitters are Light Emitting Diodes (LEDs), Organic Light Emitting diode(s) OLEDs, or, for example, laser diodes. Solid state light emitters are used since they are relatively cost effect light sources and, in general, not expensive, have a relatively large efficiency and a long life-time. The solid state light source used is preferably a UV, Violet or Blue light source due to their high efficiency. Other wavelength converting material which is possible to use as wavelength converting materials are quantum dots, which are small crystals of semiconducting material generally having a width or diameter of only a few nanometers. Such quantum dots may be incorporated in a matrix material such as a polymer (silicone, PMMA, PET) or ceramic/glass type of material. When excited by incident light, a quantum dot emits light of a color determined by the size and material of the crystal. Light of a particular color can therefore be produced by adapting the size of the dots. Most known quantum dots with emission in the visible range are based on cadmium selenide (CdSe) with a shell such as cadmium sulfide (CdS) and zinc sulfide (ZnS). Cadmium free quantum dots such as Indium phosphode (InP), and copper indium sulfide (CuInS2) and/or Silver Indium Sulfide (AgInS2) can also be used. Quantum dots show very narrow emission band and thus they show saturated colors. Furthermore the emission color can easily be tuned by adapting the size of the quantum dots. Any type of quantum dot known in the art may be used in the present invention. However, it may be preferred for reasons of environmental safety and concern to use cadmium-free quantum dots or at least quantum dots having a very low cadmium content. Organic phosphors are also usable as wavelength converting material. Organic phosphors may be molecularly dissolved/dispersed in a matrix material such as a polymer (e.g. silicone, PMMA, PET). Examples of suitable organic phosphor materials are organic luminescent materials based on perylene derivatives, for example compounds sold under the name Lumogen® by BASF. Examples of suitable compounds include, but are not limited to, Lumogen® Red F305, Lumogen® Orange F240, Lumogen® Yellow F083, and Lumogen® F170.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination may not be used to an advantage.

The invention claimed is:

1. A method for manufacturing a linear lighting device, said method comprising the steps of:

providing a sheet of optically transmissive material, a sheet of thermally conductive material, and a plurality of light sources, arranging the light sources on the sheet of thermally conductive material, roll forming the sheet of thermally conductive material into a supporting heat spreader profile, roll forming the sheet of optically transmissive material into a first shape to cover said light sources and define an optical chamber, and attaching end portions of said sheet of optically transmissive material to said supporting heat spreader profile.

2. The method of claim 1, wherein said step of attaching comprises clamping said end portions in clamping portions formed as longitudinal slots roll formed in said supporting heat spreader profile.

3. The method of claim 1, wherein said step of attaching comprises forming said sheet of optically transmissive material into a second shape.

4. The method of claim 1, wherein said step of attaching comprises crimping portions of said supporting heat spreader profile to fixate said end portions.

5. The method of claim 4, wherein crimping said portions is performed by roll forming.

6. The method of claim 4, further comprising the step of:

roll forming, after said step of attaching, the supporting heat spreader profile, such that said sheet of optically transmissive material is formed into a second shape which covers said light sources and defines an optical chamber.

7. The method of claim 1, wherein roll forming said supporting heat spreader profile comprises forming at least four longitudinal slots, said longitudinal slots being arranged in pairs either forming two slots having substantially parallel planes in a longitudinal extension or two slots forming the bottom half of an 'X', whereby said supporting heat spreader profile allows at least two possible first shapes for attaching said sheet of optically transmissive material.

8. The method of claim 1, further comprising providing at least a second sheet of optically transmissive material, roll forming said second sheet of optically transmissive material into a first shape to cover said first sheet of optically transmissive material thereby forming a second optical chamber, and attaching said second sheet to said supporting heat spreader profile.

9. The method of claim 1, further comprising the step of:

providing mounting levers connected to said linear lighting device, said mounting levers being configured to allow a user to elastically deform said supporting heat spreader profile for mounting said linear lighting device to a linear lighting device holder.

10. The method of claim 1, wherein said supporting heat spreader profile comprises a plurality of parallel linear longitudinal portions, each linear longitudinal portion being configured for attaching a sheet of optically transmissive material, and wherein the method further comprises: arranging the light sources on each linear longitudinal portion, providing a plurality of sheets of optically transmissive material, roll forming the plurality of sheets of optically transmissive material into a plurality of parallel optical chambers covering and defining an optical chamber for each linear longitudinal portion, and attaching the plurality of sheets of optically transmissive material to said heat spreader profile.

11. The method of claim 10, further comprising the step of:

separating each linear longitudinal portion of said heat spreader profile into an individual linear lighting device.

12. The method of claim 1, wherein said supporting heat spreader profile comprises a plurality of parallel linear longitudinal portions, each linear longitudinal portion being configured for attaching a sheet of optically transmissive material, and wherein the method further comprises: arranging the light sources on each linear longitudinal portion, roll forming the sheet of optically transmissive material into a plurality of parallel optical chambers covering and defining an optical chamber for each linear longitudinal portion, and attaching the sheet of optically transmissive material to said heat spreader profile.

* * * * *